US005299690A

United States Patent [19]

Mund et al.

[11] Patent Number: 5,299,690

[45] Date of Patent: Apr. 5, 1994

[54] CASCADING STACKABLE TRAYS

[75] Inventors: John W. Mund, Fox Lake, Wis.; Cari Burns; Robert Chieda, both of Wheaton, Ill.; Leon C. Clouser, Jr., Lombard, Ill.; Robert A. O'Neil, Glen Ellyn, Ill.

[73] Assignee: Sterling Plastics Co., Madison, Wis.

[21] Appl. No.: 81,017

[22] Filed: Jun. 22, 1993

[51] Int. Cl.[5] ..... A47F 3/14

[52] U.S. Cl. ..... 206/503; 211/11; 211/194; 211/126; 220/23.6

[58] Field of Search ..... 211/11, 194, 188, 126; 220/4.26, 4.27, 23.6, 23.83, 23.86; 206/503, 509, 511, 821; 217/12 R, 13; 229/DIG. 11

[56] References Cited

U.S. PATENT DOCUMENTS

| | | | |
|---|---|---|---|
| 3,482,708 | 12/1969 | Levit et al. | 211/126 |
| 3,648,849 | 3/1972 | Harris et al. | 206/503 |
| 4,074,810 | 2/1978 | Juergens et al. | 211/11 |
| 4,253,402 | 3/1981 | Carrig et al. | 211/126 |
| 4,534,475 | 8/1985 | Mayo | 211/126 |
| 4,657,148 | 4/1987 | Heng | 211/194 |
| 4,887,724 | 12/1989 | Pielechowski et al. | 211/11 |
| 5,054,629 | 10/1991 | Breen | 211/128 |

FOREIGN PATENT DOCUMENTS

| | | | |
|---|---|---|---|
| 826507 | 1/1960 | United Kingdom | 211/126 |

OTHER PUBLICATIONS

Regeneration: Upward Sales Recycle, Rogers, Madison, Wis. 53716 (A member of Newell Office Products Group) 20-716.

Desk Trays: Rising Sales, Rogers, Madison, Wis. 53716 (A member of Newell Office Products Group) 20-689.

Computer Trays: Smart Sales Program, Rogers, Madison, Wis. 53716 (A member of Newell Office Products Group) 20-741.

Desk Accessories: An Ideal Work Situation, Rogers, Madison, Wis. 53716 (A member of Newell Office Products Group) 20-730.

Your Guide to Setting up Your Laserjet III Printer, Edition 1 Copyright 1990, Hewlett-Packard Co., Page A.

*Primary Examiner*—Allan N. Shoap
*Assistant Examiner*—S. Castellano
*Attorney, Agent, or Firm*—Foley & Lardner

[57] ABSTRACT

A stackable tray system used, for example, as an organizer tray system in offices, includes two or more trays spaced vertically from one another. Support elements are provided for separating the trays and for supporting the upper tray in each tray pair. Furthermore, the support elements, in combination with the upper tray in a pair and a slide retainer, permit the upper tray to be moved horizontally with respect to the lower tray to provide a cascading appearance. With the upper tray displaced horizontally from the lower tray, access to the lower tray is facilitated, both to add material thereto or to remove contents of the tray.

4 Claims, 3 Drawing Sheets

CASCADING STACKABLE TRAYS

BACKGROUND OF THE INVENTION

1. Field of the Invention

The present invention relates generally to the field of office supplies and more particularly to trays used for organizing material. Still more specifically, the present invention relates to stackable trays used for purposes such as, but not limited, to "in-out" trays and the like.

2. Description of the Prior Art

Trays of various sizes, shapes and arrangement are common accessories in homes, offices and other businesses where it is desirable to organize materials. In many offices, for example, trays are used to sort incoming and outgoing mail, memos, etc. Typically such trays are rectangular in shape and are sized for particular types of functions. A common example of such a tray would be a plastic tray having a base and a rim or wall surrounding all or a part of the base. Small feet could be provided on the lower side of the base, and the upper surface of the base may include elongate ridges. The rim may also be provided with slots, holes or other design features.

It is also well known that such trays may be stacked, one on top of the other, to provide a space saving tray organization system. A variety of stacking techniques are known in the art, an example being to provide slots in the top of the wall or rim of one tray and ridges on the bottom of the trays, the ridges being arranged to be received within the slots, to fix one upper tray with respect to a lower tray. The process can be repeated to create a taller stack. With such systems, the upper tray, of any tray pair, is not movable horizontally with respect to the lower tray.

Stackable trays also have utility in a wide range of other applications where organization or display of different types of materials is desired. One problem, however, is that when trays are spaced apart from one another and stacked vertically, it may be difficult for the user to add or remove material from the lower tray. It would, therefore, be desirable to provide a horizontal offset of an upper tray with respect to a lower tray and even more desirable to provide a variable amount of such offset. An enhanced aesthetic appeal can also be achieved, the trays in such a system presenting a "cascading" appearance. A stackable tray system which accomplishes the foregoing design and utilitarian capabilities would represent a significant advance in the art.

SUMMARY OF THE INVENTION

The present invention features stacked trays, such as desk organizer trays, which are vertically spaced one above the other. The present invention also features a slide system which permits an upper tray to be moved horizontally with respect to the tray immediately beneath it.

The present invention also features a sliding organizer tray arrangement which may be variously configured for different size trays and which may be stacked to heights of two or more trays.

How the features of the present invention are accomplished will be described in the following detailed description of the preferred embodiment, taken in conjunction with the drawings. Generally, however, they are accomplished by providing a plurality of trays which, preferably, are of identical size and shape and include a planar bottom and a rim surrounding at least a portion thereof. The trays are spaced vertically, one above the other, by support elements which are adapted at their lower end to be releasably coupled to the rim of the lower tray and which, near their upper end, include a slide element for supporting the upper tray and permitting horizontal movement thereof with respect to the lower tray. The trays and support members are arranged so that the organizer trays of the present invention can be stacked in groups of two, three, or more trays, the only practical limitation being preventing tilting of the entire stack.

In its most preferred form, the trays and support elements are constructed from moldable, thermoplastic resins, with the support elements being formed in two halves which snap together. The lower portion of the support elements forms a channel which includes a ridge adapted to engage the grooves in the sides of the rim of the lower tray. An inwardly directed ledge is provided at the upper end of the support elements. The ledge includes a slot and a tray retainer passes through the slot. A portion of the tray retainer below the slot is wider than the slot, while the upper end of the tray retainer snaps into a receiver in lower surface of the upper tray, thereby permitting horizontal movement of the upper tray along the slot.

Other ways in which the features of the present invention are accomplished will become apparent to those skilled in the art after reading the following detailed description.

DESCRIPTION OF THE DRAWINGS

In the various FIGURES, like reference numerals are used to denote like components.

DETAILED DESCRIPTION OF THE PREFERRED EMBODIMENT

Before proceeding to the detailed description of the preferred embodiment, several general comments are warranted with regard to the scope and applicability of the present invention. First, as previously mentioned, the preferred embodiment of the invention will be illustrated as a stackable tray system including two trays. The invention has a broader applicability and could be used with three or more trays, depending on the size and configuration thereof, the primary consideration being the center of gravity and preventing tipping of the system when material is added to the individual trays.

Second, while the trays of the present invention are illustrated as being made from moldable thermoplastic resins, the trays could be made from wood or other materials known in the office supply field.

Third, the support elements of the present invention are illustrated as being prepared from two separate components which are interference fitted or snapped together, a technique which is advantageous from a manufacturing standpoint. As long as the requisite coupling and slide features are present, the support members could be made as a unitary piece.

Another area in which the invention could be modified without departing from the spirit or scope thereof is to use other techniques for joining the support elements to the trays, other than the ridge and groove systems illustrated. For example, pin and hole coupling techniques could be employed.

Finally, while the illustrated trays are shown as being rectangular with the rim surrounding the long sides of the rectangle, one shorter side and a portion of the other shorter side, the rim configuration could be varied widely. For example, the opening shown at the front of the trays in the illustrated embodiment could be narrower or wider, e.g. extending to the corners.

Figure 1:
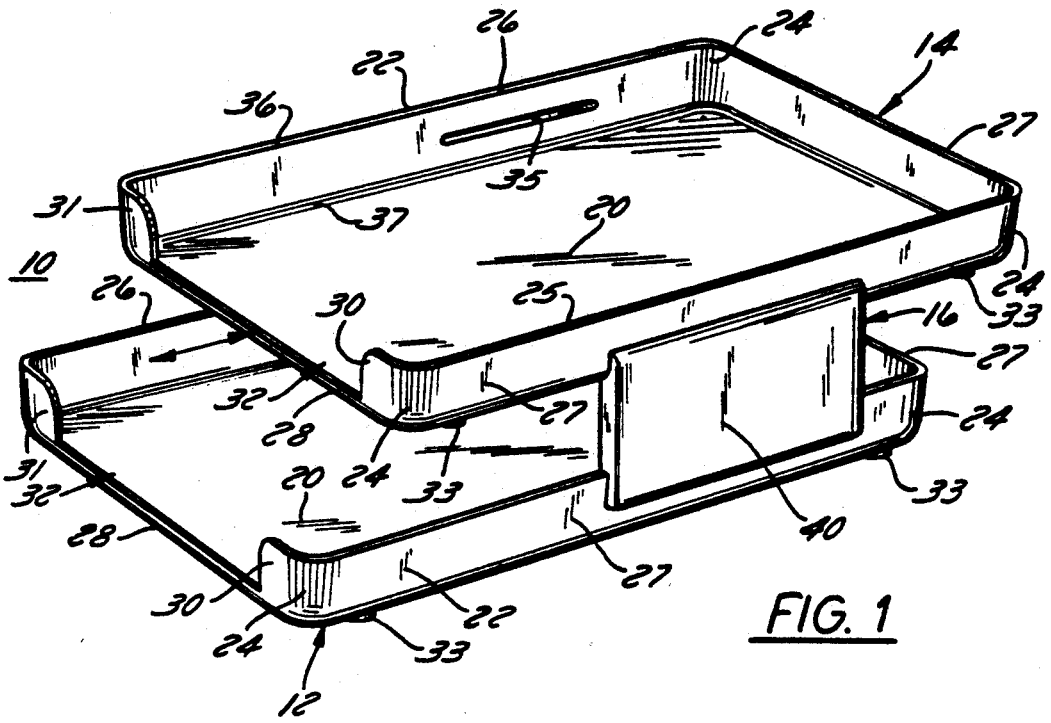
FIG. 1 is a perspective view of the stackable tray system according to the most preferred form of the present invention.

Proceeding now to the detailed description, FIG. 1 shows in perspective form the cascading tray system 10 according to the most preferred form of the present invention. System 10 includes a lower tray 12, an upper tray 14, and a pair of support elements 16, only one of which is visible in FIG. 1. The arrow showing movement in FIG. 1 should be understood at this point of the description to indicate that the upper tray 14 is movable horizontally with respect to lower tray 12 so that, in one configuration, upper tray 14 is located immediately above lower tray 12 (see FIG. 2). The preferred "use" mode is shown in FIG. 1, i.e. with upper tray 14 displaced in a horizontal direction, relative to lower tray 12, to provide an offset of the front ends of the respective trays 12 and 14. The mechanism for permitting such movement will be described in greater detail below.

In the preferred embodiment, upper trays 12 and 14 are identical, thus permitting rapid assembly of the system by the user and also to permit additional trays to be added to system 10. For example, a further tray could be placed on top of, and spaced above, tray 14 using another pair of support elements 16. It will be readily appreciated that, when the trays are in the cascading position such as shown in FIG. 1, there is a practical limit on the number of trays which can be added, as the center of gravity will eventually cause tilting of the system.

Each of trays 12 and 14 includes a rectangular, planar bottom 20 and a surrounding rim 22. In the illustrated embodiment, the bottom 20 and the rim 22 define trays having rounded corners 24, and rim 22 extends around the long sides 25 and 26 of the trays, as well as totally around one shorter end 27. This configuration is illustrative, rather than limiting. In the illustrated embodiment, rim 22 also extends part way around the other shorter end 28, and end in a pair of spaced apart terminations 30 and 31 having an opening 32 therebetween. As mentioned previously, the width of opening 32 is a matter of design choice, and the principles of the present invention would be equally applicable for trays which are totally surrounded by rim 22.

FIG. 1 also illustrates several other features of trays 12 and 14, such as the small feet 33, which may be molded into the lower surface of bottom 20 and a pair of grooves 35 extending horizontally along rim 22 at the approximate midpoint of sides 25 and 26 and between the top 36 and bottom 37 of rim 22. The groove 35 on side 25 is not visible in this perspective drawing. So that the invention assembly and construction can be readily appreciated as the descriptions continue, it should be mentioned at this point that grooves 35 are arranged to receive ridges provided on the lower part of support elements 16 to releasably join the support elements 16 to a lower tray 12.

Figure 3:
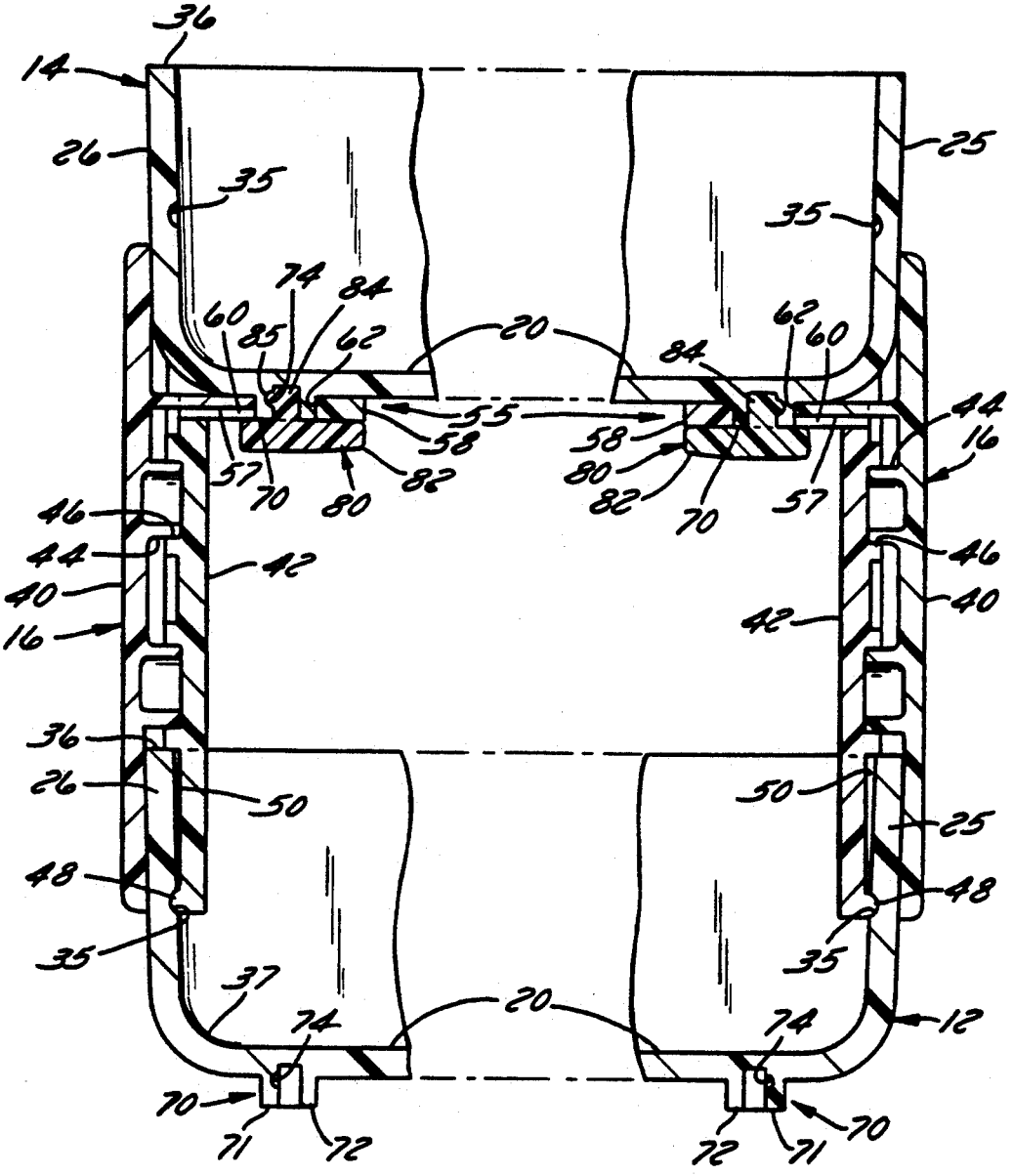
FIG. 3 is an cross-sectional view of the stackable tray system shown in FIG. 1 and illustrating in greater detail the tray retainer components.

Proceeding next to a description of FIG. 3, a sectional view is provided which shows in detail the construction of the support elements 16, as well as the preferred technique for providing the capability of horizontal movement of upper tray 14 with respect to a lower tray 12. This FIGURE should be viewed in conjunction with FIG. 4 to facilitate a greater understanding of the preferred construction technique.

It is apparent from a review of these FIGURES that support elements 16 are made from a pair of injection molded elements, an outer support component 40 and an inner support component 42. A plurality of pin 44 and socket 46 couplings are integrally molded to the interior faces of the support components 40 and 42, respectively, and the number and arrangement of such coupling components can be varied widely. It can also be noted, especially by reference to FIG. 4, that a ridge 48 is provided along the lower edge of internal support component 42.

By reference to FIG. 3, it will be noted that when support components 40 and 42 are combined, a channel 50 is formed between them at the lower end of support element 16. Channel 50 is wide enough to permit lowering of element 16 over the rim 22. The ridge 48 is arranged to engage groove 35 when the support element 16 is fully lowered over the rim 22. In this way, support element 16 is releasably joined to the lower tray 12.

The other major feature of the support elements 16 are the ledges 55 provided near their upper ends. Ledges 55 are formed by a component from each of support components 40 and 42. A flat, elongate surface 57 extends perpendicularly from support component 40 and a U-shaped molding 58 extends perpendicularly from the interior support component 42. The molding 58 defines a horizontal and rectangular opening 60 which is arranged generally perpendicularly to the rest of interior support component 42. By reference to FIG. 4, it will be appreciated that when elements 40 and 42 are combined, surface 57 slides within the opening 60 to create a narrower slot 62, defined by the interior edge of molding 58 and the interior edge of surface 57. The tops of surface 57 and molding 58 are coplanar to define the horizontal supporting ledge 55.

Figure 4:
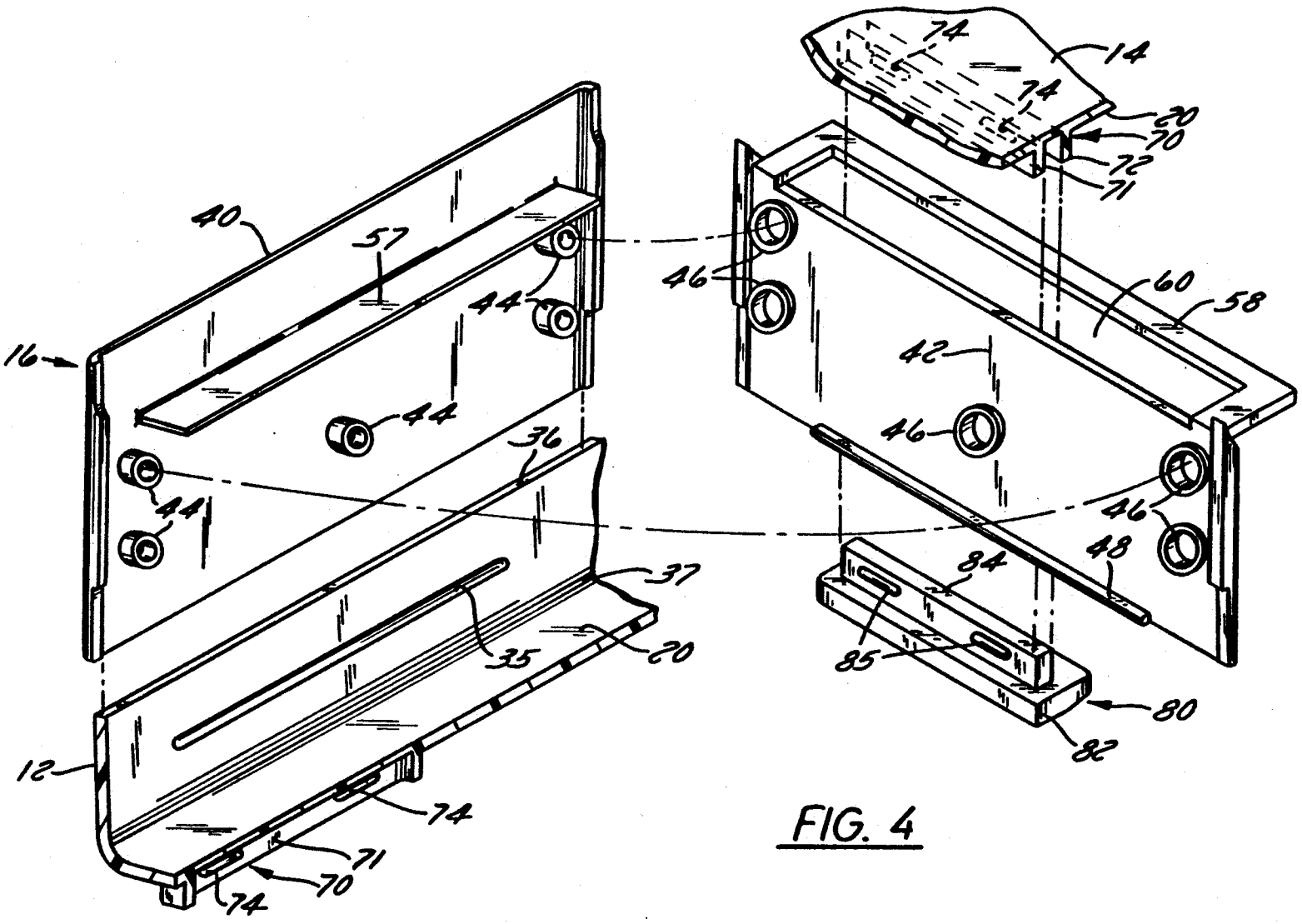
FIG. 4 is an exploded view illustrating the two halves of the support elements, the tray retainer and portions of an upper and lower tray, to facilitate an understanding of the techniques employed for assembling and manufacturing the stackable tray system of the present invention.

A further construction feature of trays 12 and 14 is also illustrated in FIGS. 3 and 4, namely receivers 70 located on either side of the trays and extending downwardly from the lower surface of bottom 20. The receivers include a pair of spaced-apart and parallel walls 71 and 72 (preferably integrally molded with the remainder of the trays). Walls 71 include a pair of short grooves 74, the purpose of which will become apparent shortly.

Figure 2:
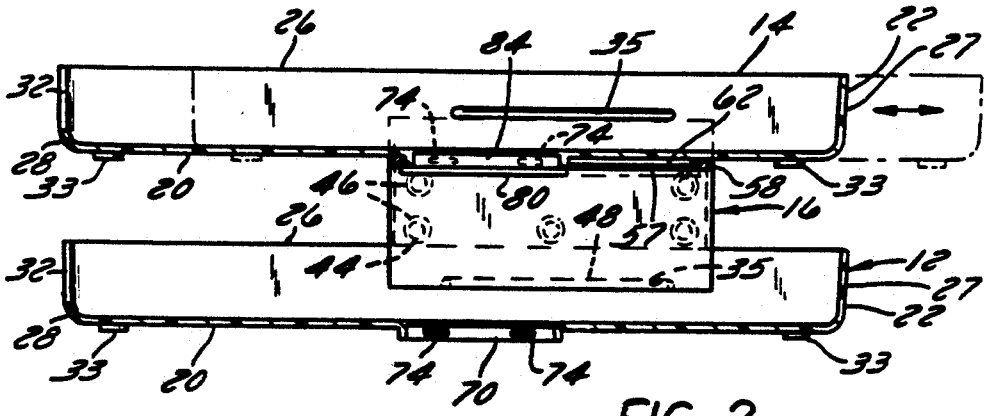
FIG. 2 is a side elevational view, partially in section and partially in phantom, showing certain components of the stackable tray system shown in FIG. 1.

Referring to FIG. 2, it will be noted that the receivers 70 are located at approximately the midpoint of the trays 12 and 14 and slightly interiorly of the sides 25 and 26.

The final component of the tray assembly 10 of the preferred embodiment of the present invention is a tray retainer 80, shown best in FIGS. 3 and 4. Retainer 80 includes a generally rectangular base plate 82 which is wider than the slot 62 and a perpendicularly extending engagement plate 84. Plate 84 includes a pair of ridges 85 arranged and constructed to engage the grooves 74 in walls 71 when the retainer 80 is inserted up through the slot 62 previously defined and into the receivers 70.

At this point, it should again be mentioned that the technique for engaging the upper tray by a retainer could be widely varied. The illustrated embodiment has been found to be particularly suitable from both a manufacturing and a structural standpoint. Once retainer 80 is releasably locked to receiver 70, movement of tray 14 with respect to tray 12 is facilitated. The retainer may slide along the length of slot 62 between the positions shown in FIG. 1 and the positions shown in full line in FIG. 2. The latter sectional view also illustrates how support element 16 fits over the rim and the physical relationships between the receivers 70 and the grooves 35.

While the present invention has been described in connection with one specific and preferred example, it is not to be limited thereby but is to be limited solely by the scope of the claims which follow.

What is claimed is:

1. A stackable tray system including two or more generally rectangular, horizontal trays spaced above one another, said trays having opposed sides, each pair of trays being separated by support elements attached to said opposed sides of the lower one of the pair of trays, the support elements each including a ledge for holding the upper tray of each pair, the upper tray of a pair being arranged for sliding horizontal movement with respect to the lower tray in its pair each ledge includes a slot and a tray retainer is inserted in each slot, the retainer including a lower portion wider than the slot, an upper portion penetrating the slot and a coupling portion attached to the upper portion, the bottom of the upper tray in each pair being arranged to receive the coupling portion of the retainer.

2. The system of claim 1 wherein each tray includes a bottom and a rim surrounding at least a portion of the bottom, a lower portion of the support elements being attached to the rim of the lower trays in each tray pair.

3. The system of claim 2 wherein the lower portions of the support elements include a pair of parallel and spaced apart walls defining a channel therebetween, the channel being arranged to fit over the rim of the lower tray.

4. The system of claim 3 wherein the rim includes a receiving area and one of the walls includes a protrusion adapted to interact with the receiving area to releasably join the support elements to the rim.

* * * * *